US011701552B2

(12) United States Patent
Rodriguez Perez

(10) Patent No.: US 11,701,552 B2
(45) Date of Patent: Jul. 18, 2023

(54) CONTROL SYSTEM FOR REGULATION BALLS IN A FOOTBALL FIELD AND REGULATION BALL SUPPORT FOR SAME

(71) Applicant: Javier Rodriguez Perez, Seville (ES)

(72) Inventor: Javier Rodriguez Perez, Seville (ES)

( * ) Notice: Subject to any disclaimer, the term of this patent is extended or adjusted under 35 U.S.C. 154(b) by 0 days.

(21) Appl. No.: 17/258,603

(22) PCT Filed: Jul. 10, 2019

(86) PCT No.: PCT/EP2019/068510
§ 371 (c)(1),
(2) Date: Jan. 7, 2021

(87) PCT Pub. No.: WO2020/011844
PCT Pub. Date: Jan. 16, 2020

(65) Prior Publication Data

US 2021/0275876 A1 Sep. 9, 2021

(30) Foreign Application Priority Data

Jul. 10, 2018 (ES) ..... 201800413U

(51) Int. Cl.
*A63B 71/00* (2006.01)
*A63B 47/00* (2006.01)
*A63B 71/06* (2006.01)

(52) U.S. Cl.
CPC ..... *A63B 47/002* (2013.01); *A63B 71/0622* (2013.01); *A63B 2071/0625* (2013.01);
(Continued)

(58) Field of Classification Search
CPC ..... A63B 69/002; A63B 69/0075; A63B 2243/007; A63B 47/002; A63B 71/0622; A63B 2243/0025
See application file for complete search history.

(56) References Cited

U.S. PATENT DOCUMENTS 5,294,111 A * 3/1994 Bloch ..... A63B 71/0686 473/415
6,424,598 B1 * 7/2002 Shultz ..... A63B 71/0686 248/116

(Continued)

FOREIGN PATENT DOCUMENTS

BR PI0903136 A2 10/2010
EP 3220378 A1 9/2017

OTHER PUBLICATIONS

International Search Report and Written Opinion for Corresponding International Application No. PCT/EP2019/068510 (10 Pages) ( dated Oct. 24, 2019).

*Primary Examiner* — Steven J Hylinski
(74) *Attorney, Agent, or Firm* — Lucas & Mercanti, LLP

(57) ABSTRACT

A control system for regulation balls in a football field and regulation ball support for same is provided. The system has ball supports arranged in a football field, a central control unit and a portable electronic device. Each ball support has presence sensors for detecting a football in a supporting base and data processing means for wirelessly communicating information from the presence sensors to the central control unit. The central control unit monitors the presence of footballs in each ball support and repeatedly sends, wirelessly, the results from the monitoring to the portable electronic device, which graphically shows on a screen the presence or absence of footballs in the corresponding ball supports.

10 Claims, 7 Drawing Sheets

(52) U.S. Cl.
CPC ... *A63B 2071/0658* (2013.01); *A63B 2220/52* (2013.01); *A63B 2220/805* (2013.01); *A63B 2225/20* (2013.01); *A63B 2225/50* (2013.01); *A63B 2225/74* (2020.08); *A63B 2243/0025* (2013.01)

(56) References Cited

U.S. PATENT DOCUMENTS

D654,382 S * 2/2012 Barr ..... D10/40
8,678,897 B2 * 3/2014 Englert ..... A63B 71/0605 463/31
8,911,308 B2 * 12/2014 Daniels ..... A63B 69/00 473/439
2005/0143199 A1 * 6/2005 Saroyan ..... A63B 71/0605 473/438
2006/0178235 A1 * 8/2006 Coughlan ..... A63B 24/0021 473/438
2007/0260421 A1 * 11/2007 Berner, Jr. ..... A43B 3/0031 702/155
2010/0184563 A1 * 7/2010 Molyneux ..... G01S 13/34 473/570
2010/0184564 A1 * 7/2010 Molyneux ..... A63B 24/0062 482/1
2011/0287878 A1 * 11/2011 Englert ..... A63B 43/00 73/514.31
2012/0010027 A1 1/2012 Morris
2012/0029666 A1 * 2/2012 Crowley ..... A61B 5/6895 700/91
2013/0040764 A1 * 2/2013 Daniels ..... A63B 69/00 473/439
2013/0274040 A1 * 10/2013 Coza ..... A63B 24/0062 473/570
2016/0243426 A1 * 8/2016 Griffin ..... A63B 69/0075

* cited by examiner

CONTROL SYSTEM FOR REGULATION BALLS IN A FOOTBALL FIELD AND REGULATION BALL SUPPORT FOR SAME

CROSS REFERENCE TO RELATED APPLICATION

This Application is a 371 of PCT/EP2019/068510 filed on Jul. 10, 2019 which, in turn, claimed the priority of Spanish Patent Application No. U 201800413 filed on Jul. 10, 2018, both applications are incorporated herein by reference.

FIELD OF THE INVENTION

The present invention refers to a control system for the location of reserve regulation footballs used during a football match.

BACKGROUND OF THE INVENTION

There are difficulties which often lead to chaos during a football match in relation to the availability of the regulation ball. These difficulties are mainly focused on the loss of time due to the ball moving away from the playing field and the ball not being available for the player performing the throw-in, for the corner kick, or for the player performing the goal kick.

Often, the gameplay, time and game rules are altered by a regulation ball not being available for the player to throw-in, the corner or goal kick and thus continue the correct course of the match. The match is often interrupted due to the withdrawal of substitution balls by members of the club, as the regulation ball is not physically available to resume the game in a throw-in, corner or goal kick, the assistant referees of the match losing visual control over the regulation ball.

These irregularities, together with other situations such as the intentional removal of ball boys by members of the local club, disrupt the course of the match, favouring time being lost or simply interrupting the course of the match to benefit the local team.

Therefore, a system is necessary which controls and facilitates the correct arrangement of regulation replacement balls during a football match.

DESCRIPTION OF THE INVENTION

The invention relates to a control system for regulation substitution balls in a football field, especially appropriate to be used during the course of a professional football match. The proposed control and regulation system for the game enables fair play to be improved and prevents the different irregularities existing in the arrangements of the regulation ball, substitution ball and the ball boys, in different throws and situations in the match.

The system enables the real-time control of the status and location of each substitution ball in designated points of the football field, outside the perimeter delimiting the playing field (mainly in the sideline, goal and corner areas). The information registered in each point arrives in real time to a mobile device carried by the fourth referee. The mobile device has an application which provides the fourth referee with control of the presence or the need to replace the regulation balls in the different designated points, thereby preventing the disappearance of balls and maintaining the control and position of the balls in real time. In this manner, time is not lost from recovering the regulation ball which, due to displacement and moving away, stays out of the control of the player and the referees of the match, and manually using the replacement ball which is deposited in the ball support of the present invention.

A first aspect of the present invention relates to a control system for regulation balls in a football field. The system comprises a plurality of ball supports, a central control unit and a portable electronic device.

The ball supports are arranged in previously established positions of a football field. Each ball support comprises a supporting base prepared to secure a football, a power source, presence sensor means configured to detect the presence of a football in the ball support, wireless communication means, and data processing means configured to receive information coming from the presence sensor means and wirelessly communicate, through the wireless communication means, information regarding the presence of the football in the ball support to a central control unit.

The central control unit, implemented for example in a computer, comprises wireless communication means configured to receive the ball presence information sent by each ball support and a processor configured to monitor the presence of a football in each support by using the received presence information and repeatedly sending, wirelessly, through the wireless communication media, the results from the monitoring to the portable electronic device (for example, an electronic tablet).

The portable electronic device comprises a processor, a wireless communication module and a screen. The processor is configured to receive, through the wireless communication module, the results from the monitoring and to graphically display the presence or absence of footballs in the corresponding ball supports.

In one embodiment, the supporting base has a cavity or hole, made in the upper portion thereof, prepared to partially house a football, the presence sensor means being located in the contour of the cavity or hole. According to one embodiment, the presence sensor means comprise at least one barrier sensor or at least one weight sensor.

The system can further comprise a remote server, in communication with the central control unit, configured to receive the results from the monitoring of the presence of a football in each ball support. The wireless communication means of each ball support can be configured to wirelessly communicate with the remote server and send information regarding the presence of a football in the ball support. In one embodiment, the wireless communication means of each ball support comprise a cellular communication module for remote communication with the server and a Wi-Fi modem for communication with the central control unit.

The portable electronic device is preferably configured to show an image representing the football field with the location of each ball support and to show a status signal which visually indicates in the image the presence or absence of a football in each ball support. The ball supports are preferably arranged along the sidelines, in the corners and behind the goals of the football field.

A second aspect of the present invention relates to a regulation ball support, for facilitating the control of regulation balls in a football field. The ball support is arranged in an established position of a football field, and comprises the following elements:

- A supporting base prepared to secure a football.
- A power source.
- Presence sensor means configured to detect the presence of a football in the ball support.
- Wireless communication means.

Data processing means configured to receive information coming from the presence sensor means and wirelessly communicate, through the wireless communication means, information regarding the presence of the football in the ball support.

The object of the present invention is also a control method for regulation balls in a football field, comprising the following steps:

Detecting the presence of a football in different ball supports arranged in established positions of a football field.

Wirelessly communicating, from each ball support to a central control unit, information regarding the presence of the football in the ball support.

Monitoring, from the central control unit, the presence of a football in each ball support by using the received presence information.

Repeatedly sending, wirelessly, from the central control unit, the results from the monitoring to a portable electronic device.

Showing on a screen of the portable electronic device the results from the monitoring, graphically representing the presence or absence of the footballs in the corresponding ball supports.

BRIEF DESCRIPTION OF THE DRAWINGS

What follows is a very brief description of a series of drawings that aid in better understanding the invention, and which are expressly related to an embodiment of said invention that are presented by way of non-limiting example of the same.

DETAILED DESCRIPTION OF THE INVENTION

Figure 1A:
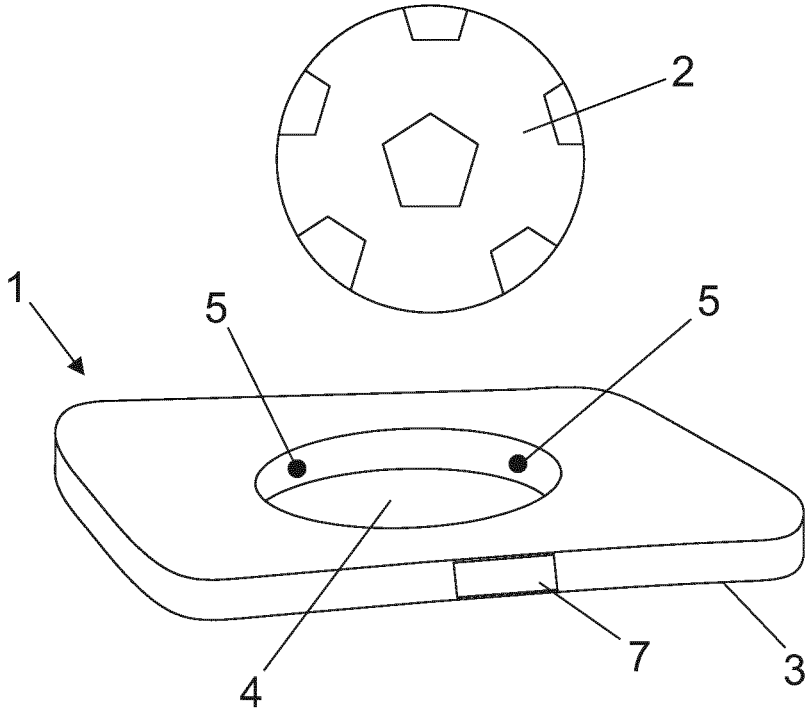
FIGS. 1A to 1K show different implementations of a ball support according to the present invention.

FIG. 1A shows, according to a possible embodiment, a ball support 1 prepared to support and retain a regulation football 2. The ball support 1 comprises a supporting base 3 prepared to secure the football 2, once it is resting in the supporting base 3.

To do so, in this particular embodiment, the supporting base 3 has a hole 4 made in the central portion thereof, with a size sufficient to partially house the football 2. The hole preferably has a circular shape with a decreasing diameter to better secure the football 2, although it can also have other shapes (i.e. square). Although the hole 4 shown in FIG. 1A passes through the supporting base 3, it could alternatively not pass through the supporting base 3, a cavity, housing or slit being used instead which is prepared to secure the football 2 so it does not roll away.

The ball support 1 also comprises presence sensor means 5 configured to detect the presence of a football 2 in the ball support 1. In the embodiment shown in FIG. 1A, the presence sensor means 5 are two infrared barrier sensors located in the contour or in the walls of the hole 4, such that when the football 2 is resting correctly in the hole 4 of the supporting base 2, both sensors 5 detect the presence of the ball. When the football 2 is not in the support 1, the presence sensor means 5 detect the absence of the football 2.

Although in this embodiment two presence sensors are shown, a single sensor could be used, or a plurality of them, greater than two, depending on the redundancy and reliability in the detection of the football 2 that are to be achieved. Furthermore, any other type of presence sensor means can be used, including force or weight sensors (which determine that the ball is resting thereon when a certain threshold of measured weight is exceeded), laser sensors, and in general any sensor suitable for detecting the presence of the football 2 in the ball support 1.

The ball support 1 can also optionally include a light alarm device 7, preferably LED, which sends a light signal to indicate the presence or absence of the ball in the ball support 1 with a certain colour in each case (for example, green to indicate the presence of the ball, and red to indicate the absence thereof in the ball support 1). In the embodiment of FIG. 1A, the use of a light alarm device 7 in the front portion of the supporting base 3 is shown, although it could be located in any other place, for example a light alarm device external to the supporting base 3, near it or integral to it.

Figure 1B:
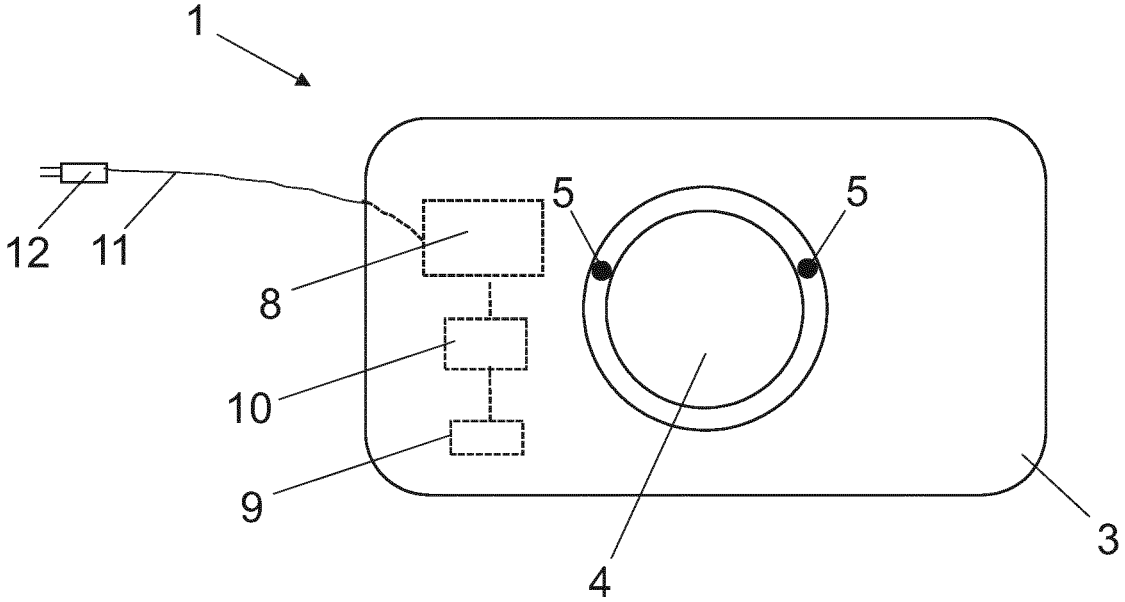

FIG. 1B shows a top view of the ball support 1 of FIG. 1A, wherein the football 2 is not shown. FIG. 1B shows, in a dotted line, electronic components of the ball support 1, housed inside the supporting base 3, although they could be arranged externally to the supporting base 3. Thus, the ball support 1 includes a power source 8 for powering the different electronic components, wireless communication means 9, and data processing means 10 (i.e. a control unit implemented for example by means of a processor or a microcontroller) configured to receive the signal captured by the presence sensor means 5, to determine the absence or presence of the football 2 in the ball support 1 and wirelessly communicate to a central control unit, through the wireless communication means 9, the presence or absence of the football 2 in the ball support 1.

In the embodiment shown in FIG. 1B (not shown in FIG. 1A) the power source 8 receives power by means of a cable connection 11 (through the pin 12) to the electrical grid. Optionally, other different or complementary methods of obtaining power could be used, such as a solar panel or one or several batteries.

Figure 1C:
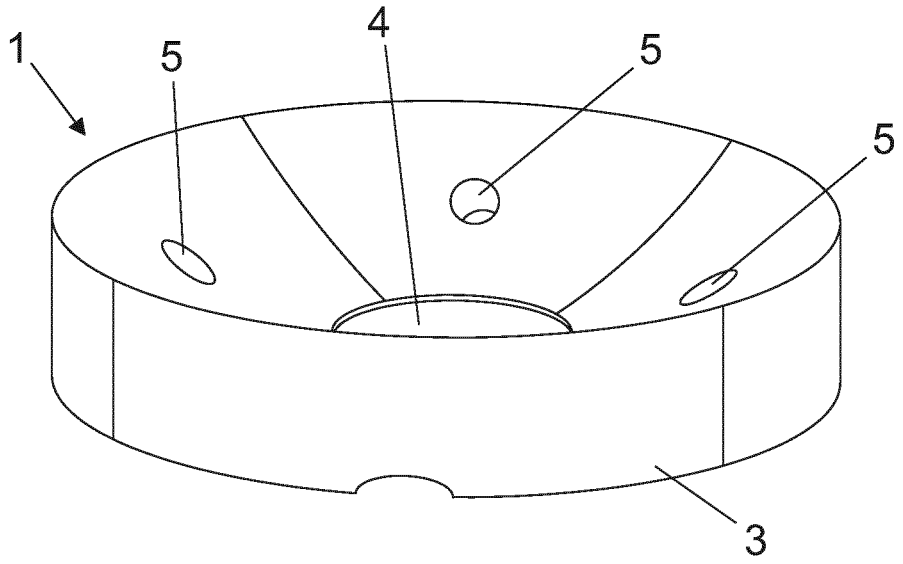

FIGS. 1C to 1K show other exemplary embodiments, by way of illustration, that the ball support 1 can adopt. In the example of FIG. 1C, the upper surface of the supporting base 1, the one responsible for receiving the football 2, adopts a spherical surface shape truncated by the hole 4. The presence sensor means 5 (four barrier sensors) are arranged in the inclined upper walls.

Figure 1D:
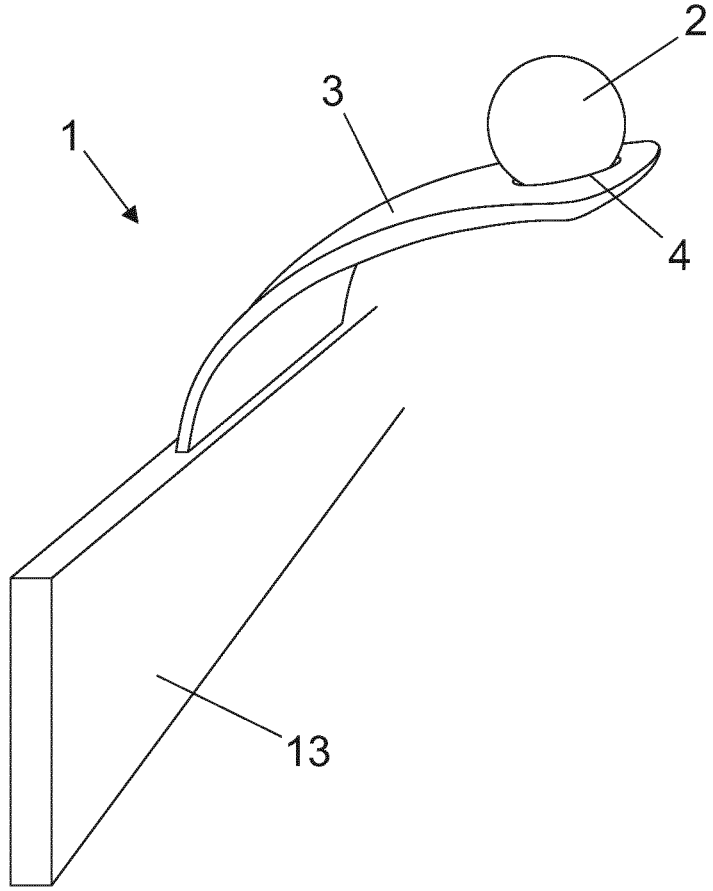
Figure 1E:
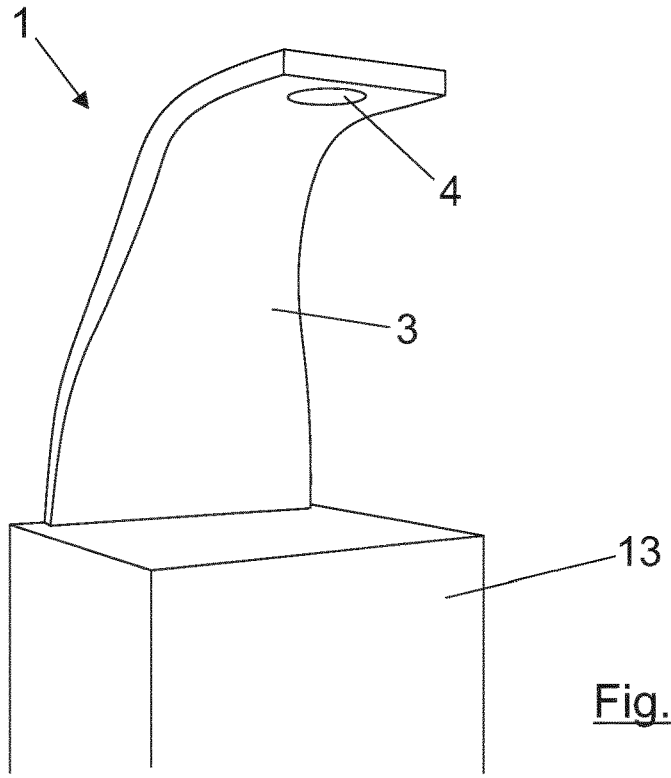
Figure 1F:
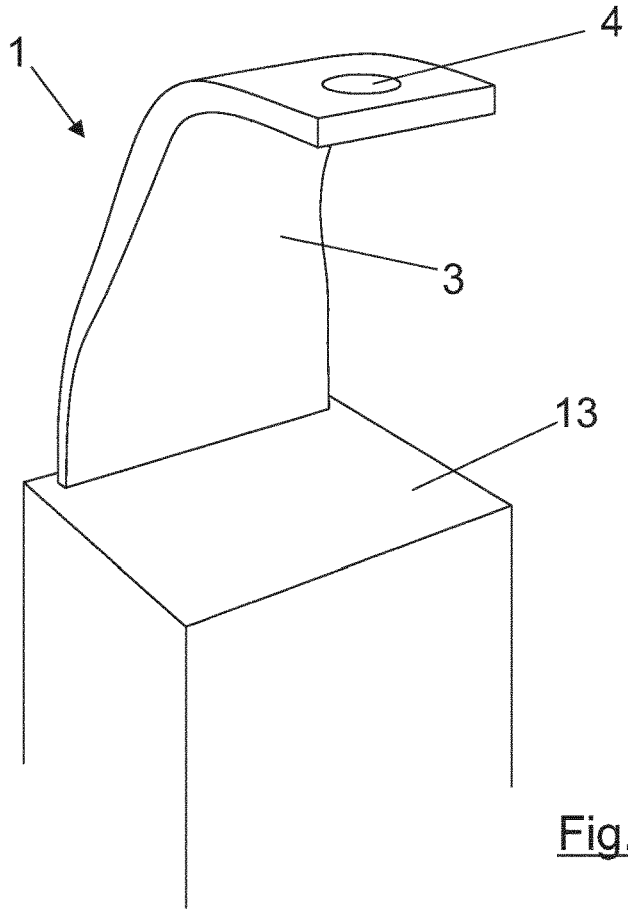
Figure 1G:
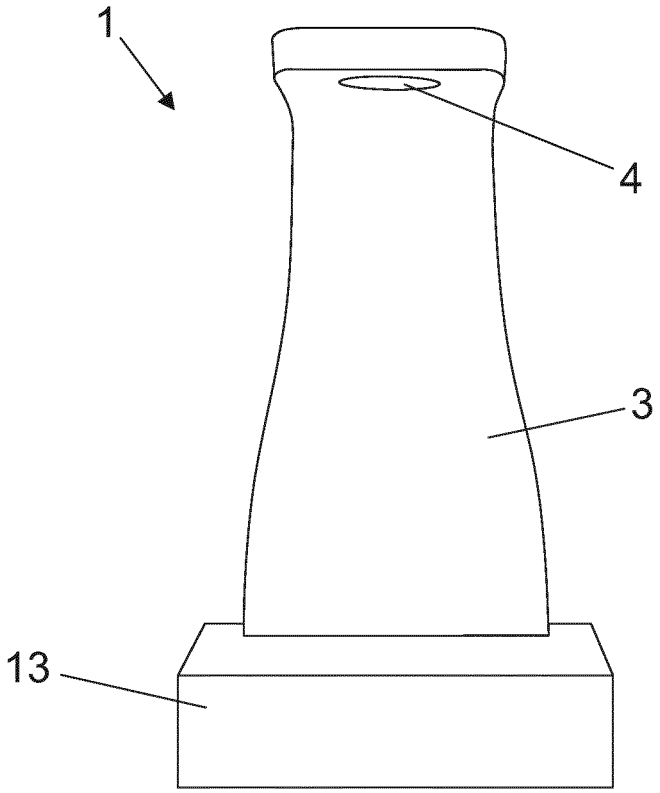
Figure 1H:
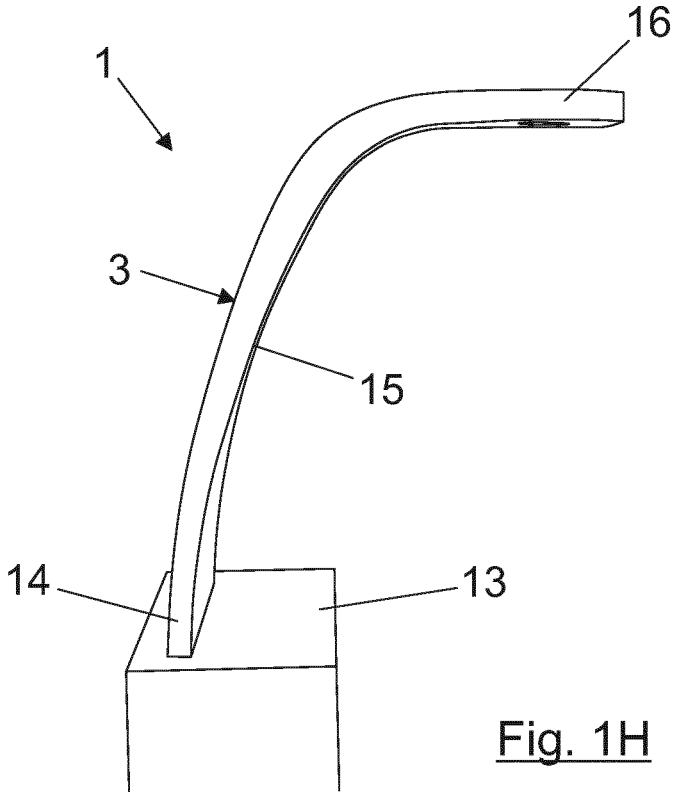

In the embodiment of FIG. 1D, a ball support 1 is shown wherein the supporting base 3 has the shape of a column or curved post, and the football rests in the opening or hole 4 made in an area near the end of the supporting base 3. The supporting base 3 can be fastened directly to the football field or, as shown in FIG. 1D, to an additional supporting structure 13, such as a fence with LED lighting for displaying advertisements.

FIGS. 1E, 1F, 1G and 1H show different views of a column-type embodiment similar to FIG. 1D, wherein the lower end 14 of the supporting base 3 extends vertically, the intermediate portion of the supporting base 3 rising with a certain inclination in order to end at a horizontal upper end 16.

Figure 1I:
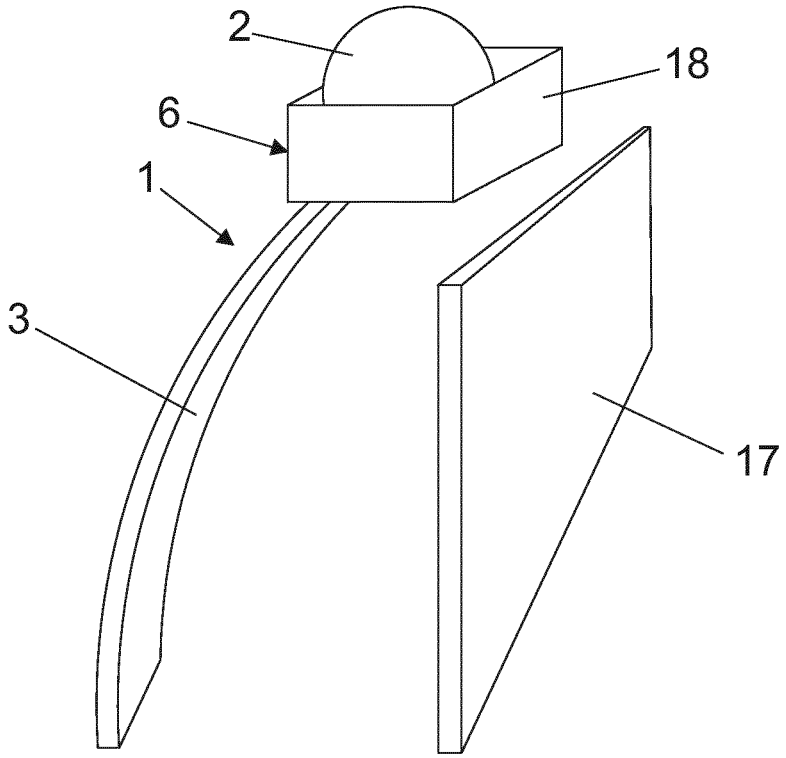
Figure 1J:
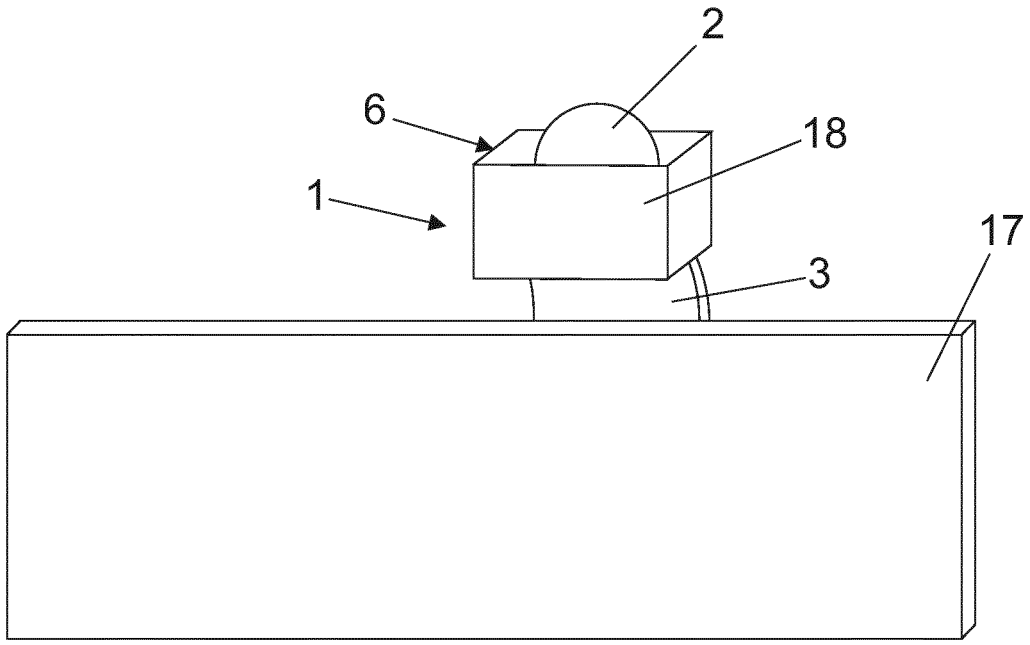

FIGS. 1I and 1J show two views of another possible embodiment of the ball support 1, wherein the supporting base 3 is implemented with a curved post which rests directly on the field of the football field, behind an LED advertising fence 17. Furthermore, the ball support 1 has a receptacle 6 which is open on the upper portion thereof which houses, at least partially, the football 2. The receptacle is integral to the supporting base 3, which can optionally have a cavity or hole 4 in the upper portion thereof in order to facilitate the securing of the football 2. The presence sensor means 5 can be arranged in the internal walls of the receptacle 6 or, alternatively, in the contour of the hole 4 of the supporting base 3 itself. The outer side walls of the receptacle 6, especially the front wall placed in front of the football field, parallel to the advertising fence 17, can be used to display an advertisement 18 adhered to the receptacle 6. The design of the receptacle 6 can be a box with open flaps, a closed box wherein a portion of the ball protrudes from the upper portion, or other different designs.

Figure 1K:
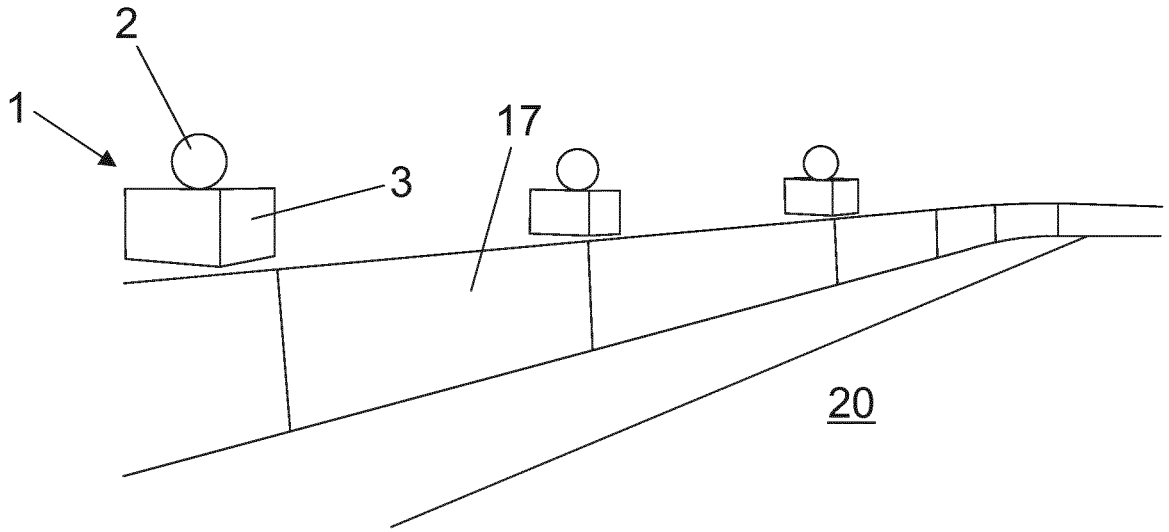

In a football field 20, multiple ball supports 1 are located in certain positions. FIG. 1K shows, according to another possible embodiment of the ball support 1, several ball supports 1 located on the sideline of a football field 20, behind the advertising fence 17, separated at a certain distance from each other. The ball support 1 shown in FIG. 1K comprises a supporting base 3 with a parallelepiped shape (although it could have other shapes), on the upper face of which the football 2 rests. In order to secure the football 2, the supporting base 3 can have a cavity or slit made in the upper face thereof (not shown in FIG. 1K), which houses the presence sensor means 5. The supporting base 3 can include advertising on the side faces thereof which is printed or adhered thereto. In this case, for a greater visibility of the advertising, the supporting base 3 is located at a height greater than the advertising fence 17.

Figure 2:
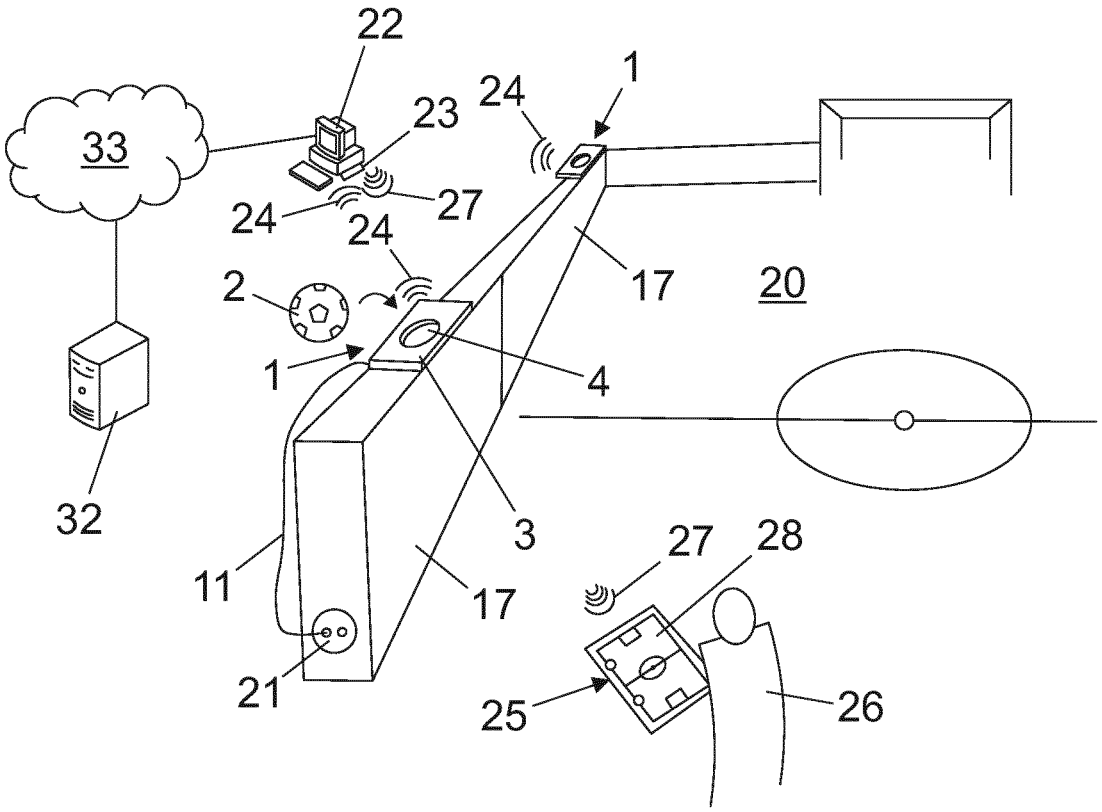
FIG. 2 schematically shows the elements of the control system for regulation balls in a football field according to the present invention.

FIG. 2 shows the elements of a control system for regulation balls in a football field according to a possible embodiment of the present invention. The system comprises a plurality of ball supports 1 arranged in established positions of a football field 20. In the example of FIG. 2, several ball supports 1 are shown according to the embodiment shown in FIGS. 1A and 1B, located along the sideline of the football field 20, above the advertising fence 17, and connected to the electrical grid through the outlet 21.

The ball supports 1 detect the presence or absence of the football 2 and inform a central control unit 22 located in the football stadium itself, preferably in a conveniently prepared room. The central control unit 22 comprises wireless communication means 23 configured to receive the ball presence information sent by each ball support 1 through a wireless signal 24.

In one embodiment, the central control unit 22 is implemented by means of a computer and the wireless communication means 23 are implemented by means of a Wi-Fi router or module which establishes a secure Wi-Fi communication (i.e. 2.4 Ghz, 5 Ghz) with the ball supports 1. Alternatively, other wireless communication protocols can be used (i.e. Zigbee) with the suitable range capacity (several tens or hundreds of metres).

The central control unit 22 comprises data processing means (a processor) configured to monitor the presence of a football in each ball support 1 by using the received presence information. The central control unit 22 repeatedly sends, wirelessly, through the wireless communication means 23, the results from the ball presence monitoring to a portable electronic device 25 carried by an assistant 26 (preferably the fourth referee). Said information is sent through a wireless signal 27, for example a Wi-Fi signal.

The portable electronic device 25 (preferably implemented by means of an electronic tablet, although a portable computer, a smartphone, a phablet or a similar portable device could also be used), comprises a processor, a wireless communication module and a screen 28. The processor of the portable electronic device 25, through the execution of an installed ad-hoc application, receives (using the wireless communication module) the wireless signal 27 sent by the central control unit 22 with the results from the monitoring of the presence or absence of footballs 2 in the different ball supports 1 installed in the football field 20. The processor then graphically displays (or updates), on the screen 28 of the portable electronic device 25, the updated presence or absence of footballs in the corresponding ball supports 1.

Figure 3:
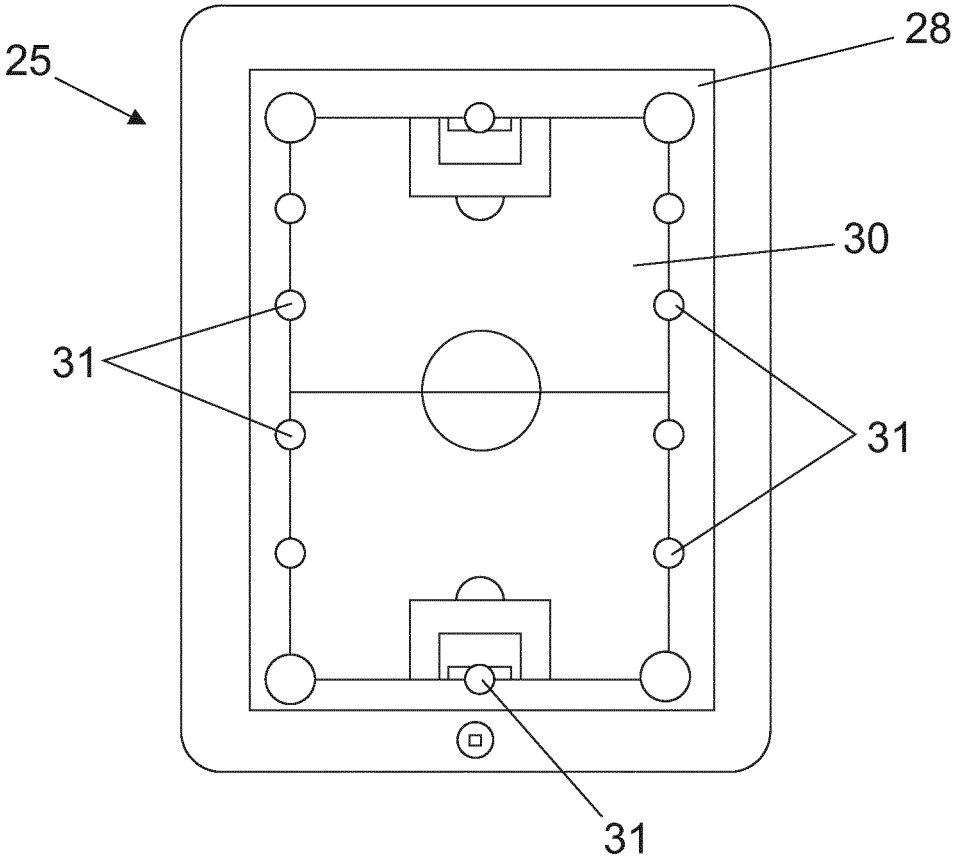
FIGS. 3 and 4 show the graphic representation, made in a portable electronic device, of the status of the presence of a ball in each ball support.

FIG. 3 shows, by way of example, the graphical representation made by the portable electronic device 25 on the screen 28 thereof. In the embodiment of FIG. 3, the image 30 shown on the screen 28 represents the football field with the location of each ball support.

Through a status signal 31 in each location, the presence or absence of a ball in each ball support 1 is visually indicated in the image 30. For example, a blue status signal 31 can indicate the presence of a ball, and a red status signal 31 can indicate the absence of a ball in the corresponding ball support. In a preferred embodiment, as seen in the example of FIG. 3, the ball supports 1 are arranged along the sidelines of the football field (four arrangement points for the substitution balls on each sideline), in the corners (four arrangement points) and behind the goals (two arrangement points).

In this manner, the assistant 26 can have the correct arrangement of the footballs in the previously determined locations of the football field under control at all times, quickly and visually, instructing the ball boys to perform the correct replacement of those footballs which take longer to be replaced.

The application of the portable electronic device 25 can even visually or audibly alert the referee when a football 2 is absent from a ball support 1 for more than a certain amount of time, for example by means of the flashing of the status signal 31 associated with said ball support in the image 30. Each ball support 1, located at a point for arranging a substitute ball, can have an assigned ball boy who is responsible for replacing the football 2 in the ball support 1. In that case, the assistant 26 will call on the corresponding ball boy, for example by means of audio communication (i.e. by using a walkie talkie), to replace the substitute ball in the corresponding ball support 1.

Alternatively, the ball support 1 itself can control, through a timer, the time wherein the football is not present in the supporting base 3, such that if the accumulated absence time exceeds a certain threshold, it warns about said situation. The alarm can be a light alarm (by means of the light alarm 7), an audible alarm (by means of a built-in audible alarm device) or an alert message sent wirelessly to the central control unit 22 or the portable electronic device 25.

Returning to FIG. 2, the central control unit 22 can also be configured to send the results from the monitoring of the presence of the footballs 2 in the ball supports 1 to a remote server 32, located in a location removed from the football field 20. The communication between both devices (22, 32) can be performed in different manners, for example by Internet 33, or by cellular communications (i.e. 4G, the upcoming 5G, etc.). In one embodiment, the ball supports 1 themselves have a cellular communication module (i.e. a 4G modem) through which they send the ball presence information directly to the remote server 32. The remote server 32 can monitor the presence of regulation balls in different football matches simultaneously. The statistics of each match will be saved on the remote server 32 for different uses (internal, marketing and commercial, etc.).

Figure 4:
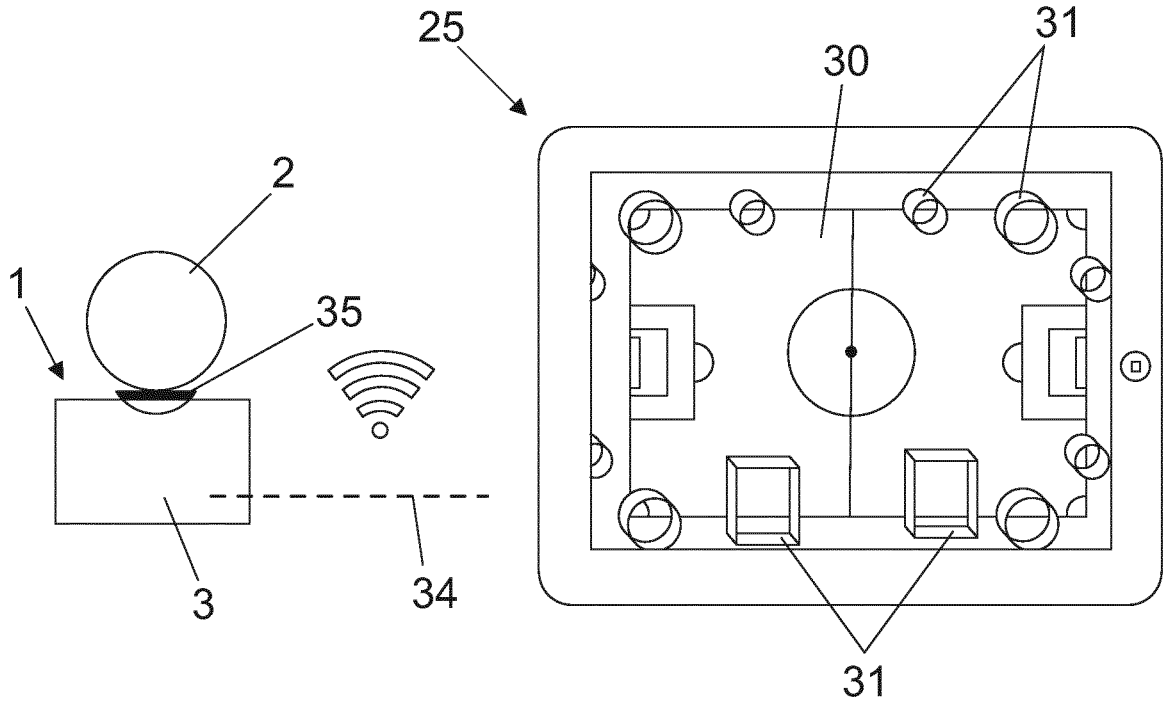

FIG. 4 shows, according to another possible embodiment, the graphic representation, made by the portable electronic device 25 on the screen 28 thereof, of the image 30 with the status signals 31 of each ball support 1. In this case, the shapes of the status signals 31 determine the presence (circular shape) or absence (square shape) of the regulation balls in the ball supports 1. Different colours (i.e. blue for presence, red for absence) can also be used to emphasise the presence or absence of a ball.

In the example of FIG. 4, each ball support 1 establishes a direct wireless communication 34 with the portable electronic device 25, the application executed by the processor of the portable electronic device 25 being responsible for monitoring the presence/absence status of the ball supports and update the corresponding status signal 31 in the image 30. In the example of FIG. 4, instead of a cavity, housing or slit prepared to secure the football 2, a platform 35 is used which is integral to the upper portion of the supporting base 3 (or a projection present on the upper face).

The invention claimed is:

1. A system for controlling the correct arrangement of substitution footballs in a football field during a football match, comprising:

a plurality of ball supports arranged in established positions outside of a football field, wherein each one of the plurality of ball supports comprises:

a supporting base prepared to secure a substitution football;

a power source;

presence sensor means configured to detect the presence or absence of the substitution football in the ball support;

wireless communication means; and data processing means configured to receive information coming from the presence sensor means and wirelessly communicate, through the wireless communication means, information regarding the presence or absence of the substitution football in the ball support to a central control unit;

the central control unit, comprising:

wireless communication means configured to receive the substitution football presence information sent by each one of the plurality of ball supports; and a processor, configured to monitor the presence or absence of the substitution football in each one of the plurality of ball supports using the received presence information and repeatedly send, wirelessly, through the wireless communication means, the results from the monitoring to a portable electronic device; and the portable electronic device, comprising a processor, a wireless communication module and a screen, the processor being configured to receive, through the wireless communication module, the results from the monitoring and emit a visual or audible alert signal to replace substitution footballs when one of the substitution football is absent from each of the plurality of ball supports for an amount of time determined by the portable electronic device.

2. The system according to claim 1, wherein the supporting base has a cavity or hole, made in the upper portion thereof, prepared to partially house a football, the presence sensor means being located in the contour of the cavity or hole.

3. The system according to claim 2, wherein the presence sensor means comprise at least one barrier sensor.

4. The system according to claim 1, further comprising a remote server, in communication with the central control unit, configured to receive the results from the monitoring of the presence of a football in each ball support.

5. The system according to claim 4, wherein the wireless communication means of each ball support are configured to wirelessly communicate with the remote server and send information regarding the presence of a football in the ball support.

6. The system according to claim 5, wherein the wireless communication means of each ball support comprise a cellular communication module for remote communication with the server and a Wi-Fi modem for communication with the central control unit.

7. The system according to claim 1, wherein the portable electronic device is an electronic tablet.

8. The system according to claim 1, wherein the central control unit is a computer.

9. The system according to claim 1, wherein the portable electronic device is configured to show:

an image which represents the football field with the location of each ball support;

a status signal which visually indicates in the image the presence or absence of a football in each ball support.

10. The system according to claim 1, wherein the ball supports are arranged along the sidelines, in the corners and behind the goals of the football field.

* * * * *